United States Patent [19]

Carver et al.

[11] 4,169,061

[45] Sep. 25, 1979

[54] FIBER TREATING COMPOSITIONS

[75] Inventors: Bobby C. Carver; Raymond E. Donaldson, both of Kingsport, Tenn.

[73] Assignee: Eastman Kodak Company, Rochester, N.Y.

[21] Appl. No.: 878,342

[22] Filed: Feb. 16, 1978

Related U.S. Application Data

[63] Continuation of Ser. No. 679,257, Apr. 22, 1976, abandoned.

[51] Int. Cl.[2] ..... D06M 13/10

[52] U.S. Cl. ..... 252/8.9; 252/8.7; 8/115.6

[58] Field of Search ..... 252/8.9, 8.7; 8/115.6

[56] References Cited

U.S. PATENT DOCUMENTS

| | | | |
|---|---|---|---|
| 2,425,755 | 8/1947 | Roberts et al. | 260/615 B |
| 3,503,880 | 3/1970 | McMickens | 252/8.75 |
| 3,518,184 | 6/1970 | Potter | 252/8.75 |
| 3,563,892 | 2/1971 | Colley | 252/8.7 |
| 3,907,689 | 9/1975 | Carver | 252/8.7 |

*Primary Examiner*—William E. Schulz

*Attorney, Agent, or Firm*—Clyde L. Tootle; Daniel B. Reece, III

[57] ABSTRACT

This invention relates to a fiber treating composition which can be applied to partially oriented polyester fiber. The fiber treating composition contains as the lubricant a blend of at least two random copoly(oxyethyleneoxypropylene) butanols. Processing aids conventional in the art should also be added to the lubricant. Such aids include antistat agents such as for example at least one of the members of the group consisting of an alkali metal alkyl sulfosuccinate, an ethoxylated fatty alcohol phosphoric acid potassium salt and/or an alkali metal alkyl benzene sulfonate or combinations of at least one of these antistat agents with other conventional antistat agents or processing aids. Fibers having the textile treating composition deposited thereon can be texturized satisfactorily by the friction twist method.

32 Claims, No Drawings

FIBER TREATING COMPOSITIONS

This is a continuation of Application Ser. No. 679,257 filed Apr. 22, 1976, now abandoned.

This invention relates to the lubrication and conditioning of textile yarns and filaments. More particularly, this invention relates to fiber treating compositions particularly useful on polyester textile yarn in draw texturizing operations.

As is well known in the manufacture of most types of yarns, it is necessary to place a fiber treating composition onto the yarn in order to reduce the tendency of the yarn toward breakage of the individual filaments or fibers when they are subjected to various mechanical processing treatments such as spinning, twisting, winding and other various operations. One such operation in the processing of partially oriented polyester filament yarns is texturizing, In texturizing, the process involves false twisting and heat-setting the twist and untwisting a yarn fed continuously through the process. Partially oriented polyester filament yarns are currently being texturized commercially by either the false twist pin method or the newer, more demanding friction twist method. Both of these methods employ passing the yarn over a heater plate. Conventional texturizing yarns suitable for processing by the pin twist method are not suitable for processing on friction twist equipment due to excessive heater deposits and polymer abrasion at the friction discs which is due partially to increased speed and volume through put. It would therefore be an advance in the state of the art to provide a textile lubricant which can be applied to polyester yarns which can be processed on friction twist equipment at increased speeds without excessive heater deposits and abrasion by the friction disc.

It is therefore an object of the present invention to provide a textile treating composition suitable for high temperature processing of synthetic yarns.

Another object of this invention is a yarn lubricated with the novel lubricant which can be used in the production of highly uniform, textured yarn.

A still further object of the invention is to provide a composition for the lubrication of polyester yarns at elevated temperatures without adversely affecting the properties of the yarn.

One still further object of this invention is to provide a composition which can be applied to polyester yarns which can be texturized satisfactorily by the friction twist method.

Further objects and advantages of the invention will be apparent to those skilled in the art from the accompanying disclosure and claims.

In accordance with the present invention, a textile treating composition is provided for use on textile fibers formed from thermoplastic material. The textile treating composition contains as a lubricant a blend of a major amount of a random copoly(oxyethylene-oxypropylene) butanol containing 50 mole percent ethylene oxide having a viscosity lower than 300 seconds at 100° F. in Saybolt Universal Seconds (SUS), and a minor amount of a random copoly(oxyethylene-oxypropylene) butanol containing 50 mole percent ethylene oxide having a viscosity of not less than 2,000 seconds at 100° F. in Saybolt Universal Seconds (SUS). In addition to the lubricant, the textile treating composition should also contain processing aids conventional in the art. Such aids include antistat agents such as, for example, at least one of the members of the group consisting of an alkali metal alkyl sulfosuccinate, an alkali metal alkyl benzene sulfonate, and/or an ethoxylated fatty alcohol alkali metal phosphate or combinations of these antistate agents or combinations of these antistat agents with other conventional antistat agents or processing aids. While the lubricant can be used without the addition of a processing aid, for the most preferred processing results it is desirable to use such aids. The textile treating composition can be applied directly to the synthetic fiber, or a carrier or diluent, such as water, can be used and the textile treating composition applied to the fiber as an emulsion.

The textile treating compositions of the present invention are particularly useful in the manufacture of partially oriented polyester fibers. Partially oriented polyester fibers containing the textile treating compositions at low lubricant levels can be wound on packages at high speeds and maintain good package build relatively free from winding defects. The partially oriented polyester fiber can subsequently be draw-textured to produce varn which is relatively free from short-term dye variations. Moreover, in processing the fiber containing the textile treating composition by draw-texturizing, less force is required to draft the fiber. Also, the accumulation of deposits on the heater plates and draw-texturizing equipment is of an acceptable level. The textile treating composition also reduces the level of smoke and does not form insoluble deposits on the heater plates at the temperatures necessary for friction-texturizing.

The textile treating composition which provides the lubricity to the yarn comprises a blend of at least two different random copoly(oxyethylene-oxypropylene) butanols containing 50 mole percent ethylene oxide. One such blend contains about 99 to 51, preferably 75 to 50, more preferably 75 to 55, percent, by weight, of textile treating composition of a random copoly(oxyethylene-oxypropylene) butanol having a preferred viscosity of 100 at 100° F. in Saybolt Universalt Seconds (SUS), and about 10 to 49, preferably 20 to 45, most preferably 30 to 25, percent, by weight, of textile treating composition of a random copoly(oxyethylene-oxypropylene) butanol having a preferred viscosity of 5100 at 100° F. in Saybolt Universal Seconds (SUS). One method for preparing the poly(oxyethylene-oxypropylene) butanols of the present invention is shown in U.S. Pat. No. 2,425,755. Of the polyoxyalkylenes useful for this invention, the weight ratio of ethylene oxide groups, i.e., the groups $(CH_2\text{-}CH_2\text{-}O)$, to propylene oxide groups, i.e., the groups $$\left(CH_2-\underset{\underset{CH_2}{|}}{CH}-O\right)$$

is preferably between about 3:1 and 1:3, most preferably 1:1 in order that the material remain fluid and water-soluble. It is important that the viscosity of the polyoxyalkylene diol blend be between 500 and 5,000 SUS at 100° F. If the viscosity is too low, broken filaments of the yarn carrying the finish result; whereas, if the viscosity is too high, unwanted twist-slippage in the draw-texturing process occurs. Generally, if the viscosity of the monohydroxy alcohol polyoxyalkylene component is high, less is needed and vice versa.

The textile treating composition preferably also contains at least one processing aid selected from the group of (1) an alkali metal alkyl sulfosuccinate such as sodium dioctyl sulfosuccinate; and (2) an alkali metal salt of a phosphoric acid mono- or diester of an ethylene oxide adduct of at least one member selected from the group consisting of a $C_8$ to $C_{18}$ linear alkyl alcohol. Such alkali metal salts of a phosphoric acid mono- or diester of an ethylene oxide adduct of at least one member selected from the group consisting of a $C_8$ to $C_{18}$ linear alkyl alcohol are, for example: POE (3) octyl potassium phosphate, POE (2) decyl potassium phosphate, POE (4) lauryl potassium phosphate, POE (5) octyl potassium phosphate, POE (5) decyl potassium phosphate, POE (5) lauryl potassium phosphate, POE (5) myristyl potassium phosphate, POE (5) cetyl potassium phosphate, POE (5) stearyl potassium phosphate, POE (10) octyl potassium phosphate, POE (12) decyl potassium phosphate, POE (16) lauryl potassium phosphate, POE (18) stearyl potassium phosphate, POE (20) octyl potassium phosphate, POE (25) cetyl potassium phosphate, POE (8) dinonyl phenol potassium phosphate and the like; or (3) an alkali metal salt of alkylbenzene sulfonate as, for example: sodium octyl benzene sulfonate, sodium decyl benzene sulfonate, sodium dodecyl benzene sulfonate, and the like. A single processing aid can be used with the lubricant or a combination of these processing aids with each other or with other processing aids.

The lubricant can be prepared by mixing the components in a container and heating to 60°–70° C. until all components are melted and blended. The blended oil is then poured with agitation into 30°–40° water to give a clear solution of the desired oil in water concentration. Also, each component can be merely added to the water with mixing to provide a water clear solution.

The textile treating composition can be applied directly to the fiber or can be applied with a carrier, such as water, in solution. Aqueous solution can be prepared at any ratio of oil to water. Emulsions containing from 1 to 50 weight percent of the textile treating composition are preferred with those containing about 5 to 25 weight percent being most preferred. The method of application can affect the amount added to the yarn. Rolls use dilute solutions whereas metering pumps can use more highly concentrated solutions.

The textile treating composition is normally applied to the yarn soon after the yarn exits from the spinning cabinet and prior to its being wound on a package. The textile treating composition can also be applied by immersion or as a spray, or by any other means during winding. A preferred method is to apply the composition by passing the yarn over a pair of rotating finish rolls. The finish rolls are normally located ahead of the godet rolls, but they could be located between or after the godet rolls. The yarn contact with the finish rolls is controlled by guides which are located before and after each roll. Very light contact with the finish roll is preferred. While finish rolls commonly used in the trade are generally made of aluminum oxide type materials, other materials such as metal rolls and flame coated rolls could be used. Two finish rolls are preferred in most cases; however, finishes have been successfully applied with one roll. More than two rolls could be used but they would be expensive and they are thought to be unnecessary. Methods other than rotating rolls can be used to apply the finish to the yarn. Yarn finishes can be applied by immersion, wicking devices, and sprays or other atomizing type devices.

When using rotating finish rolls to apply finish to a yarn from an emulsion, the amount of finish applied will depend on the yarn speed, contact angle with the roll, finish roll speed, yarn size, and filament count and the percent of oil in the emulsion. The preferred level of oil in the emulsion is between 5% and 25%. It is felt that a straight oil would work if a satisfactory method of applying it could be devised. Solutions of oil in organic solvents could be used as long as the solvent had no adverse effect on the yarns.

The preferred finish level is from 0.2% to 2% by weight; however, yarns having 0.1% to 2.5% have been used. Higher levels could be used but it would cost more and it is expected that the deposit build-up on the draw texturing equipment would be greater than at the preferred level.

The textile treating compositions of the present invention provide yarn frictional properties which are suitable for both winding and draw-texturing. Yarns with these finishes have performed well in draw-texturing, as evidenced by threadline tensions, low deposit buildup on equipment and by the acceptable properties and uniform dyeing of the textured yarns.

This invention will be further illustrated by the following examples although it will be understood that these examples are included merely for purposes of illustration and are not intended to limit the scope of the invention.

EXAMPLE 1

The following components are blended to form a solution. The lubricant components and their weight percentage composition is:

| | |
|---|---|
| Random copoly(oxyethylene-oxypropylene) butanol containing 50 mole percent ethylene oxide having a viscosity of 100 at 100° F. (SUS) (Ucon 50 HB-100) | 55% |
| Random copoly(oxyethylene-oxypropylene) butanol containing 50 mole percent ethylene oxide having a viscosity of 5100 at 100° F. (SUS) (Ucon 50 HB-5100) | 30% |
| POE (5) lauryl phosphoric acid - potassium salt | 9% |
| Sodium dodecyl benzene sulfonate | 6% |
| | 100% |

EXAMPLE 2

The following components were blended to form a solution. The lubricant components and their weight percentage composition is:

| | #2 | #3 | #4 |
|---|---|---|---|
| Random copoly(oxyethylene-oxypropylene) butanol containing 50 mole percent ethylene oxide having a viscosity of 55 at 100° F. (SUS) (Ucon 50 HB-55) | | 73 | |
| Random copoly(oxyethylene-oxypropylene) butanol containing 50 mole percent ethylene oxide having a viscosity of 100 at 100° F. (SUS) (Ucon 50 HB-100) | 75 | | 75 |
| Random copoly(oxyethylene-oxypropylene) butanol containing 50 mole percent ethylene oxide having a viscosity of 5100 at 100° F. (SUS) (Ucon 50 HB-5100) | 20 | 22 | 20 |
| POE (6) lauryl phosphoric acid - potassium salt | | | 3 |
| POE (8) dinonylphenyl phosphoric acid - potassium salt | 3 | 3 | 2 |
| Sodium dodecyl benzene sulfonate | 2 | 2 | |

The above four fiber lubricants were evaluated on 150 denier partially oriented polyester filament yarn. These lubricants provided excellent package winding performance as well as good draw texturizing with a minimum of snow, disc deposits, and the like.

The textile treating compositions of the present invention provide the art with lubricants which can be used to prepare fully drawn or partially oriented thermoplastic yarns, such as nylon and polyester. The partially oriented yarn can be draw texturized, either simultaneously or sequentially, to provide full drawn yarn having consistent dye uniformity. The lubricants can be processed satisfactorily on conventional textile equipment without excessive build-up of deposits on heated surfaces and spindles. These improved textile compositions also have low volatility and do not provide an excessive amount of smoking. Also, yarn having these textile treating compositions can be draw textured with less force required to draw the yarn.

Although the invention has been described in considerable detail with particular reference to certain preferred embodiments thereof, variations and modifications can be effected within the spirit and scope of the invention.

We claim:

1. A textile treating composition comprising as the lubricant a blend of a major amount of a random copoly(oxyethyleneoxypropylene) butanol having a viscosity of lower than 300 seconds at 100° F. in Saybolt Universal Seconds (SUS) containing a weight ratio of ethylene oxide groups to propylene oxide groups of 3:1 to 1:3, and a minor amount of a random copoly(oxyethylene-oxypropylene) butanol having a viscosity of not less than 2000 seconds at 100° F. in Saybolt Universal Seconds (SUS) containing a weight ratio of ethylene oxide groups to propylene oxide groups of 3:1 to 1:3, said polyoxyalkylene blend having a viscosity between 500 and 5,000 SUS at 100° F.

2. A textile treating composition according to claim 1 wherein said random copoly(oxyethylene-oxypropylene)butanol has a viscosity of 100 at 100° F. containing a weight ratio of ethylene oxide groups to propylene oxide groups of 3:1 to 1:3.

3. A textile treating composition according to claim 2 wherein said random copoly(oxyethylene-oxypropylene) butanol has a viscosity of 5100 at 100° F. containing a weight ratio of ethylene oxide groups to propylene oxide groups of 3:1 to 1:3.

4. A textile treating composition according to claim 3 containing as a processing aid from about 1 to 8 percent by weight of an alkali metal alkyl benzene sulfonate; and/or about 1 to 12 percent by weight of an ethoxylated fatty alcohol alkali metal phosphate.

5. A textile composition according to claim 4 wherein said alkali metal benzene sulfonate is present in an amount of about 2 to about 6 percent by weight.

6. A textile treating composition according to claim 5 wherein said ethoxylated fatty alcohol alkali metal phosphate is present in an amount of about 2 to about 9 percent by weight.

7. A textile treating composition according to claim 6 wherein said alkali metal benzene sulfonate is sodium dodecyl benzene sulfonate.

8. A textile treating composition according to claim 7 wherein said ethoxylated fatty alcohol alkali metal phosphate is POE (5) lauryl potassium phosphate.

9. A textile treating composition comprising as the lubricant a blend of 75 to 55 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 3:1 to 1:3, and 20 to 45 percent by weight of a random copoly(oxyethyleneoxy-propylene) butanol having a viscosity of not less than 2000 seconds at 100° F. in Saybolt Universal Seconds (SUS) containing a weight ratio of ethylene oxide groups to propylene oxide groups of 3:1 to 1:3, said polyoxyalkylene blend having a viscosity between 500 and 5,000 SUS at 100° F.

10. A textile treating composition according to claim 9 wherein said random copoly(oxyethylene-oxpropylene)butanol having a viscosity of 100 at 100° F. containing a weight ratio of ethylene oxide groups to propylene oxide groups of 1:1.

11. A textile treating composition according to claim 10 wherein said random copoly(oxyethylene-oxypropylene)butanol having a viscosity of 5100 at 100° F. containing a weight ratio of ethylene oxide groups to propylene oxide groups of 1:1.

12. A textile treating composition according to claim 11 containing as a processing aid from about 1 to 8 percent by weight of an alkali metal alkyl benzene sulfonate; and/or about 1 to 12 percent by weight of an ethoxylated fatty alcohol alkali metal phosphate.

13. A textile composition according to claim 12 wherein said alkali metal benzene sulfonate is present in an amount of about 2 to about 6 percent by weight.

14. A textile treating composition according to claim 13 wherein said ethoxylated fatty alcohol alkali metal phosphate is present in an amount of about 2 to about 9 percent by weight.

15. A textile treating composition according to claim 14 wherein said alkali metal benzene sulfonate is sodium dodecyl benzene sulfonate.

16. A textile treating composition according to claim 15 wherein said ethoxylated fatty alcohol alkali metal phosphate is POE (5) lauryl potassium phosphate.

17. A textile treating composition comprising as the lubricant a blend of 75 to 55 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 25 to 45 percent by weight of a random copoly(oxyethyleneoxypropylene) butanol having a viscosity of not less than 2000 seconds at 100° F. in Saybolt Universal Seconds (SUS) containing a weight ratio of ethylene oxide groups of propylene oxide groups of 1:1, said polyoxyalkylene blend having a viscosity between 500 and 5,000 SUS at 100° F.

18. A textile treating composition according to claim 17 wherein said random copoly(oxyethylene-oxypropylene)butanol having a viscosity of 100 to 100° F. containing a weight ratio of ethylene oxide groups to propylene oxide groups of 1:1.

19. A textile treating composition according to claim 18 wherein said random copoly(oxyethylene-oxypropylene)butanol having a viscosity of 5100 at 100° F. containing a weight ratio of ethylene oxide groups to propylene oxide groups of 1:1.

20. A textile treating composition according to claim 19 containing as a processing aid from about 1 to 8 percent by weight of an alkali metal alkyl benzene sulfonate; and/or about 1 to 12 percent by weight of an ethoxylated fatty alcohol alkali metal phosphate.

21. A textile composition according to claim 20 wherein said alkali metal benzene sulfonate is present in an amount of about 2 to about 6 percent by weight.

22. A textile treating composition according to claim 21 wherein said ethoxylated fatty alcohol alkali metal phosphate is present in an amount of about 2 to about 9 percent by weight.

23. A textile treating composition according to claim 22 wherein said alkali metal benzene sulfonate is sodium dodecyl benzene sulfonate.

24. A textile treating composition according to claim 23 wherein said ethoxylated fatty alcohol alkali metal phosphate is POE (5) lauryl potassium phosphate.

25. A textile treating composition comprising as the lubricant a blend of 75 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 20 percent by weight of a random copoly(oxyethylene-oxypropylene)butanol having a viscosity of not less than 2000 seconds at 100° F. in Saybolt Universal Seconds (SUS) containing a weight ratio of ethylene oxide groups to propylene oxide groups of 1:1, said polyoxyalkylene blend having a viscosity between 500 and 5,000 SUS at 100° F.

26. A textile treating composition comprising as the lubricant a blend of 75 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 20 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, said polyoxyalkylene blend having a viscosity between 500 and 5,000 SUS at 100° F.

27. A textile treating composition comprising as the lubricant a blend of 55 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 30 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, said polyoxyalkylene blend having a viscosity between 500 and 5,000 SUS at 100° F.

28. A textile treating composition comprising as the lubricant a blend of 73 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 22 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, said polyoxyalkylene blend having a viscosity between 500 and 5,000 SUS at 100° F.

29. A textile treating composition comprising 55 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, 30 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, 9 percent by weight of POE (5) lauryl phosphoric acid - potassium salt and 6 percent by weight of sodium dodecyl benzene sulfonate.

30. A textile treating composition comprising 75 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, 20 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, 3 percent by weight of POE (8) dinonylphenyl phosphoric acid - potassium salt and 2 percent by weight of sodium dodecyl benzene sulfonate.

31. A textile treating composition comprising 73 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 22 percent by weight of a random copoly(oxyethyleneoxypropylene) butanol having a viscosity of not less than 2000 seconds at 100° F. in Saybolt Universal Seconds (SUS) containing a weight ratio of ethylene oxide groups to propylene oxide groups of 1:1, 3 percent by weight of POE (8) dinonylphenyl phosphoric acid - potassium salt and 2 percent by weight of sodium dodecyl benzene sulfonate.

32. A textile treating composition comprising 75 percent by weight of a random copoly(oxyethylene-oxypropylene) butanol having a viscosity of lower than 300 seconds at 100° F. in Saybolt Universal Seconds (SUS) containing a weight ratio of ethylene oxide groups to propylene oxide groups of 1:1, and 20 percent by weight of a random copoly(oxyethylene-oxypropylene) butanol having a viscosity of not less than 2000 seconds at 100° F. in Saybolt Universal Seconds (SUS) containing a weight ratio of ethylene oxide groups to propylene oxide groups of 1:1, 2 percent by weight of POE (8) dinonylphenyl phosphoric acid - potassium salt and 3 percent by weight of POE (6) lauryl phosphoric acid - potassium salt.

* * * * *